US005375654A

United States Patent [19]

Hougland et al.

[11] Patent Number: 5,375,654

[45] Date of Patent: Dec. 27, 1994

[54] TURBULATING HEAT EXCHANGE TUBE AND SYSTEM

[75] Inventors: Jerry M. Hougland; Lloyd F. Hay, both of Oakdale, Calif.

[73] Assignee: FR Mfg. Corporation, Stockton, Calif.

[21] Appl. No.: 153,180

[22] Filed: Nov. 16, 1993

[51] Int. Cl.[5] ..... F28F 13/12; F28F 1/42; F28D 7/10

[52] U.S. Cl. ..... 165/109.1; 165/154; 165/177; 165/181; 138/38

[58] Field of Search ..... 165/109.1, 181, 154, 165/177; 138/38

[56] References Cited

U.S. PATENT DOCUMENTS

| | | | |
|---|---|---|---|
| 1,852,490 | 4/1932 | Sullivan . | |
| 1,887,036 | 11/1932 | Modine . | |
| 1,977,809 | 10/1934 | Sutter | 165/154 |
| 2,197,243 | 4/1940 | Moran | 138/38 |
| 2,204,613 | 6/1940 | Nelson et al. | 165/172 |
| 2,259,433 | 10/1941 | Kitto | 165/154 |
| 2,343,542 | 3/1944 | Faunce . | |
| 2,864,588 | 12/1958 | Booth et al. . | |
| 2,882,023 | 4/1959 | Rizzo . | |
| 3,177,936 | 4/1965 | Walter . | |
| 3,453,840 | 7/1969 | Nagakura et al. | 165/154 |
| 3,684,007 | 8/1972 | Ragi | 165/133 |
| 3,741,285 | 6/1973 | Kuethe | 165/1 |
| 3,786,653 | 1/1974 | Blomberg | 165/179 X |
| 3,861,462 | 1/1975 | McLain | 165/179 |
| 3,885,622 | 5/1975 | McLain | 165/179 |
| 3,902,552 | 9/1975 | McLain | 165/179 |
| 4,018,209 | 4/1977 | Bonvicini | 126/121 |
| 4,044,797 | 8/1977 | Fujie et al. | 138/38 |
| 4,111,402 | 9/1978 | Barbini | 366/338 |
| 4,154,296 | 5/1979 | Fijas | 165/179 |
| 4,216,825 | 8/1980 | Sumitomo | 165/109.1 |
| 4,216,826 | 8/1980 | Fujikake | 165/133 |
| 4,223,539 | 9/1980 | Webb et al. | 62/476 |
| 4,245,695 | 1/1981 | Fujikake | 165/133 |
| 4,314,587 | 2/1982 | Hackett | 138/38 |
| 4,330,036 | 5/1982 | Satoh et al. | 165/179 |
| 4,332,294 | 6/1982 | Drefahl et al. | 138/38 X |
| 4,352,378 | 10/1982 | Bergmann et al. | 138/38 |
| 4,353,350 | 10/1982 | Albrecht | 126/121 |
| 4,402,359 | 9/1983 | Carnavos et al. | 165/70 |

(List continued on next page.)

FOREIGN PATENT DOCUMENTS

| | | | |
|---|---|---|---|
| 121693 | 5/1989 | Japan | 165/177 |
| 50086 | 2/1990 | Japan | 165/177 |
| 725075 | 3/1955 | United Kingdom | 138/38 |
| 2090651 | 7/1982 | United Kingdom . | |
| 615349 | 7/1978 | U.S.S.R. | 165/179 |
| 1252646 | 8/1986 | U.S.S.R. . | |

OTHER PUBLICATIONS

Brochure, "Triple-Tube Heat Exchnager", Feldmeier Equipment, Inc., 6800 Town Line Road, Syracuse, NY 13211 (undated).

*Primary Examiner*—John Rivell
*Assistant Examiner*—L. R. Leo
*Attorney, Agent, or Firm*—Wood, Herron & Evans

[57] ABSTRACT

Heat exchange apparatus including a tube having inward projections or turbulating structure extending into the tube at substantially all angular locations around the diameter of the tube except along a drainage path extending along the entire bottom inner surface of the tube. The width of the drainage path is sufficient to ensure that fluid may fully drain from the tube. No turbulating structure is positioned within the drainage path so as to prevent fluid from draining from the tube and potentially contaminating the tube. The turbulating structure of the invention are dimples which are deformed into the tube and have smoothly sloping side walls which further inhibit the dimples from preventing full drainage of the tube. The tubes are fixed to the apparatus at an angle which provides a drainage slope.

6 Claims, 2 Drawing Sheets

U.S. PATENT DOCUMENTS 4,425,942 1/1984 Hage et al. ..... 138/38
4,470,452 9/1984 Rhodes ..... 165/153
4,559,999 12/1985 Servas et al. ..... 165/156
4,585,059 4/1986 Lee ..... 165/154
4,621,953 11/1986 McGuth ..... 406/193
4,658,892 4/1987 Shinohara et al. ..... 165/133
4,660,630 4/1987 Cunningham et al. ..... 165/133
4,690,211 9/1987 Kuwahara et al. ..... 165/177
4,700,771 10/1987 Bennett et al. ..... 165/1
4,705,103 11/1987 Zogg et al. ..... 165/110
4,715,436 12/1987 Takahashi et al. ..... 165/133
4,733,698 3/1988 Sato ..... 138/38
4,751,964 6/1988 Borbely et al. ..... 165/147
4,760,710 8/1988 Takagi ..... 62/354
4,794,983 1/1989 Yoshida et al. ..... 165/133
4,800,954 1/1989 Noguchi et al. ..... 165/153
4,866,830 9/1989 Zohler ..... 29/890
4,880,054 11/1989 Yoshida et al. ..... 165/133
4,899,812 2/1990 Altoz ..... 165/109.1
4,921,042 5/1990 Zohler ..... 165/179
4,960,169 10/1990 Granetzke ..... 165/173
4,981,170 1/1991 Dierbek ..... 165/109.1
4,991,643 2/1991 Price et al. ..... 165/38
5,044,429 9/1991 Sakaya et al. ..... 165/104.26
5,052,476 10/1991 Sukumoda et al. ..... 165/133
5,070,937 12/1991 Mougin et al. ..... 165/133
5,107,922 4/1992 So ..... 165/109.1
5,111,878 5/1992 Kadle ..... 165/176
5,181,560 1/1993 Burn ..... 165/162

TURBULATING HEAT EXCHANGE TUBE AND SYSTEM

BACKGROUND OF THE INVENTION

The present invention generally relates to heat exchange apparatus employing tubes which contain fluid flow within a heat exchange system. More particularly, the invention pertains to heat exchange tubes used in such apparatus and having internal projections or turbulating structure for promoting more efficient heat transfer by the apparatus.

Heat exchange tubes are used to transfer heat between two media by utilizing, for example, a so-called "tube-in-tube" design or a "shell-in-tube" design. In a "tube-in-tube" design the fluid product to be heated or cooled flows through a product tube or series of product tubes and the heating or cooling media flows through an outer media tube or series of media tubes usually in a countercurrent fashion with respect to the product flow. Thus, heat is transferred between the media flowing in the inner space between the walls of the media and product tubes and the fluid product flowing through the product tubes or tubes. In a "shell-in tube" design the product tubes are disposed within a container referred to as a shell and within which the heating or cooling media flows over all of the product tubes from an inlet to an outlet thereof to transfer heat between the media and the product.

To improve heat transfer efficiency the product tubes in either a tube-in-tube design or shell-in-tube design have included turbulating structure of various configurations to promote turbulent flow within the tube. Generally stated, turbulent flow increases the heat transfer efficiency of the tube by distributing the fluid flowing therethrough across the entire diameter of the tube and not in streams flowing generally parallel to the axis of the tube. Since a higher rate of heat transfer occurs adjacent the wall of the product tube, ideally a flow pattern is created which eliminates a temperature gradient within the fluid at any cross section taken through the tube. Various types of turbulating structure have been disclosed, for example, in U.S. Pat. Nos. 2,343,542; 4,314,587; 4,330,036; 4,425,942; 4,470,452; 4,794,983; and 4,880,054.

A problem which exists in all of the known prior art is that of obtaining a maximum amount of turbulence within a heat exchange tube while still allowing fast, complete drainage of the tube at the end of a heating or cooling process. This is especially critical in the food processing industry where product tubes which contain, for example, fluid food product such as juice must be drained and sterilized after use to prevent the growth of bacteria. Fast, complete drainage of the product tubes is therefore necessary to inhibit bacterial contamination of the processing equipment and subsequent contamination of fluid food product. Prior heat exchange tubes with turbulating structure have included such structure on an inner bottom surface of the tube such that even when the tube is drained, some product is prevented from exiting the tube by the turbulating structure. In the food industry this product is left in the tube to promote harmful bacteria growth. Other heat exchange tubes have failed to provide turbulating structure which both maximizes heat transfer efficiency and allows fast, complete drainage of the tube.

SUMMARY OF THE INVENTION

It has therefore been an object of the present invention to provide a heat exchange tube which both maximizes turbulent flow within the tube and provides for fast, complete drainage of product from the tube at the end of a heating or cooling process.

The present invention is embodied in a heat exchange tube which may be used, for example, in either a tube-in-tube or shell-in-tube heat exchange system and is specifically designed for use in the food processing industry or other industries where fast, complete drainage of the tube is critical. In the preferred embodiment the tube includes inward projections or turbulating structure extending into the tube at substantially all angular locations around the diameter of the tube except along a drainage path extending along the entire bottom inner surface of the tube. The width of the drainage path is sufficient to ensure that fluid may fully drain from the tube. In other words, no turbulating structure is positioned within the drainage path so as to prevent fluid from draining from the tube and potentially contaminating the tube. Preferably, the turbulating structure of the invention comprises dimples which are deformed into the tube and have smoothly sloping side walls which further inhibit the dimples, especially those proximate the drainage path, from preventing full drainage of the tube.

In the preferred embodiment the tube is cylindrical and the width of the smooth drainage path is defined within boundaries disposed on either side of the center of the path, i.e., on either side of the "six o-clock" position of the tube as viewed from one end. The width of the drainage path is chosen to allow full drainage of the particular fluid to be heated or cooled within the tube. Thus, the width of the drainage path depends on physical characteristics, such as the viscosity, of the fluid flowing through the tube as well as the size of the tube and the size of the dimples. In use, the tube is fixed in place in a heat exchange system so as to have a slope suitable for drainage of the tube.

The heat exchange tube of the invention may be used in conventional heat exchange systems such as those utilizing a tube-in-tube or shell-in-tube design. In the preferred embodiment a series of heat exchange tubes of the invention are used as the inner product tubes of a food processing heat exchange system having a tube-in-tube design. The inner product tubes are centered within outer media tubes by a plurality of centering dimples formed in the media tubes.

DETAILED DESCRIPTION OF THE PREFERRED EMBODIMENT

Figure 1:
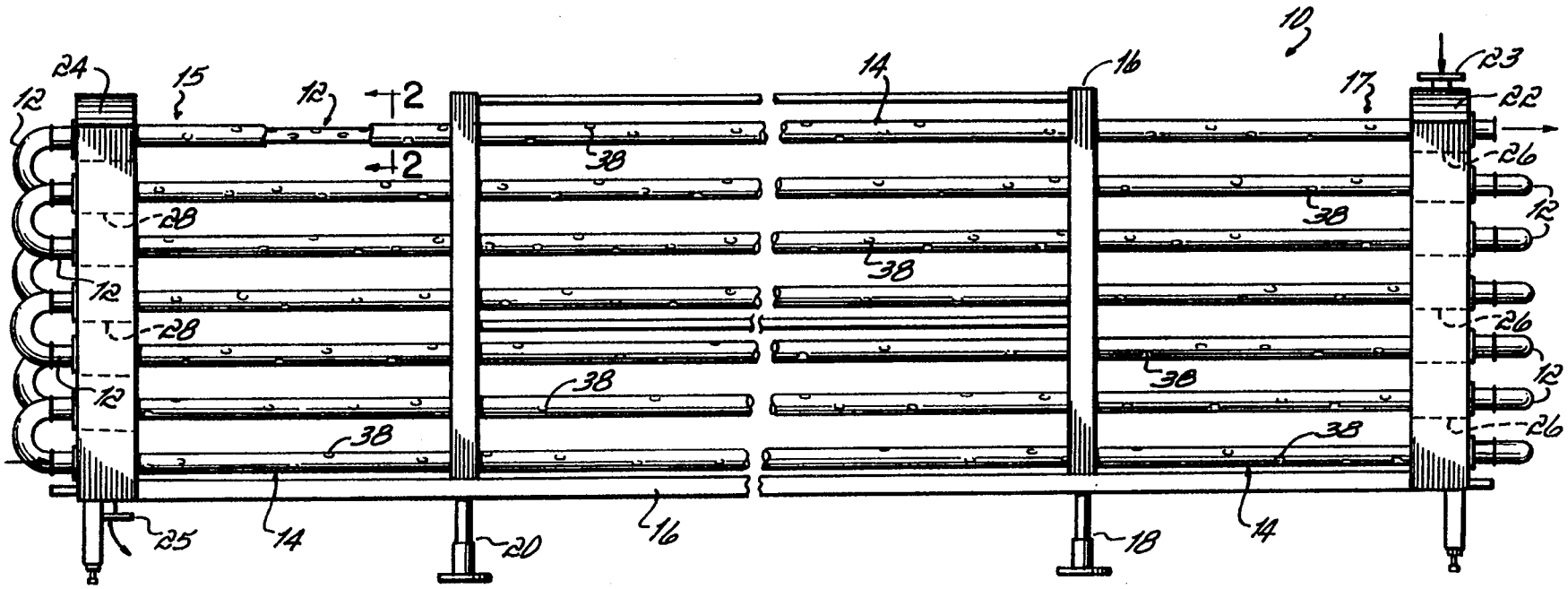
FIG. 1 is a front elevational view of a tube-in-tube heat exchange system utilizing product and media tubes of the present invention.

A heat exchange apparatus 10 is shown in FIG. 1 and includes a series of product tubes 12 and media tubes 14 with a tube-in-tube design. That is, each media tube 14 contains a product tube 12 and heat transfer takes place therebetween as heating or cooling media flows through media tubes 14 and fluid product flows through product tubes 12. The apparatus 10 includes a frame 16 which secures the tubes 12, 14 so as to provide a slight but sufficient drainage slope to each product tube 12. The apparatus further includes independently height adjustable feet 18, 20 for supporting the apparatus 10 on a support surface such as a floor.

Apparatus 10 includes media chambers 22, 24, as is conventional, for directing media such as heated or cooled water through media tubes 14 in a countercurrent fashion with respect to product flow within product tubes 12. Media chamber 22 includes a media inlet 23 while media chamber 24 includes a media outlet 25. Media therefore enters at inlet 23, flows through the series of media tubes 14 and through media chamber 24, and exits at outlet 25 where it may then be directed back into inlet 23, for example, after being directed through a chiller or heater. Suitable baffles 26, 28 are provided in a known manner for directing the flow of media within the respective media chambers 22, 24 such that all media gets directed back and forth within the various tubes 14 in a single pass fashion before exiting at outlet 25.

Figure 2:
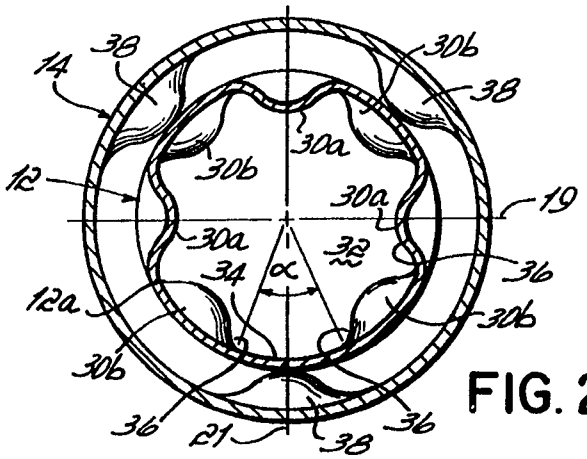
FIG. 2 is a cross sectional view of the heat exchange system of FIG. 1 taken along line 2—2.
Figure 3:
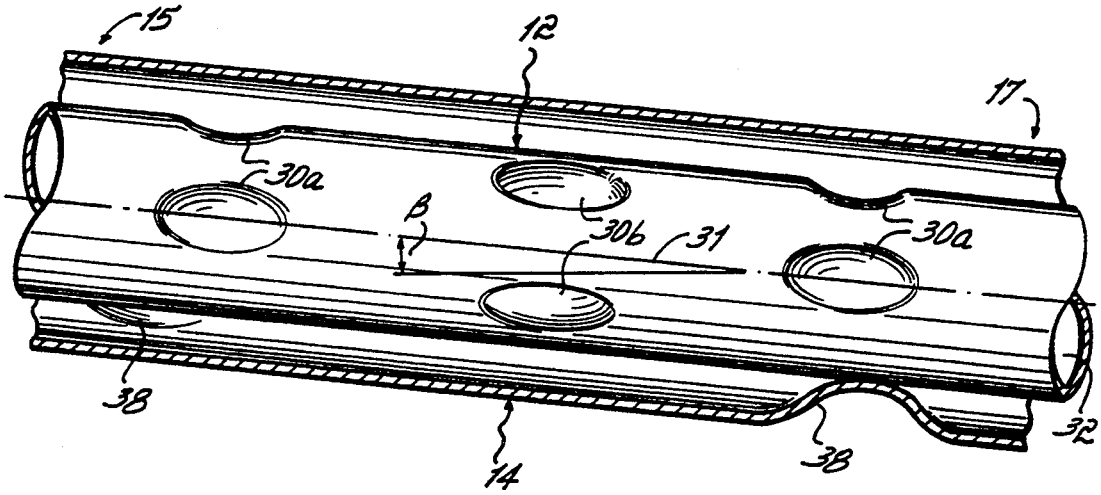
FIG. 3 is a cross sectioned side view of a media tube of the present invention showing a product tube therein and the drainage slope thereof in exaggerated form.

The apparatus 10 is preferably utilized in the food processing industry where full drainage of the system is critical as explained above. As shown in FIG. 2, inner product tubes 12 include a series of inwardly extending dimples **30*a*, 30*b* preferably disposed along the entire length of each product tube 12. Inner hollow space 32 receives a flow of fluid food product such as tomato juice, for example, which needs to be heated or cooled before being used in further processing operations. Dimples 30*a*, 30*b* are placed about the periphery of the product tubes but are absent along the bottom surface of each product tube 12 so as to create a smooth drainage path 34 for the fluid product. Furthermore, each dimple is generally convexly shaped, as viewed from inside product tube 12 (FIG. 2) and concavely shaped as viewed from outside product tube 12 as shown in FIG. 3. This provides smoothly curved, sloping surfaces 36 which aid in preventing fluid product from being obstructed by the dimples 30*a*, 30*b*** when product is drained.

As illustrated in FIG. 2, the dimples are placed about walls **12*a* of product tubes 12 such that, as viewed from one end as in FIG. 2, dimples are located above and below a horizontal axis 19 disposed perpendicular to central longitudinal axis 31 as well as on both sides of a vertical axis 21 disposed perpendicular to central longitudinal axis 31 such that maximum turbulence is promoted while maintaining a smooth drainage path 34 along the entire bottom inner surface of each tube 12. Preferably, the drainage path is contained within an angle $\alpha$ of about 30° to 90° from the central axis 31 of the product tube 12 as shown in FIG. 2. That is, the two boundaries of the drainage path 34 located on opposite sides of the drainage path centerline 34 are each generally disposed from about 15° to 45° from the centerline of the drainage path 34 or, in other words, the "six o-clock" position of the product tube 12. The center of the drainage path 34 of each product tube 12 is preferably located directly below the central longitudinal axis 31 of the product tube 12. Most preferably, dimples 30*a* are placed along the top of the product tube 12, i.e., at the 12 o'clock position, and at 90° on either side thereof, i.e., at the 3 o'clock and 9 o'clock positions, in one series of radial planes and then at 45° increments thereto in an alternating series of radial planes. However, no dimples are located at the 6 o'clock position as shown in FIG. 2**.

As shown in exaggerated form in FIG. 1, each product tube 12 and media tube 14 is secured to frame 16 and within media chambers 22, 24 at a slight angle to level (horizontal) such that a drainage slope or downward slope $\beta$ is established between an upstream end 15 and a downstream end 17 of each product tube 12 (FIG. 3). Of course, since fluid is flowing back and forth in the tubes 12, 14 as shown in FIG. 1, some tube-in-tube combinations will be sloped right to left and others will be sloped left to right as viewed in FIG. 1 depending on the direction of the product fluid flow in the respective product tubes 12. The drainage slope may, for example, be about $\frac{1}{8}$" per foot but may also be varied according to the needs of a particular system or the physical characteristics of the fluid product.

As mentioned above, outer tubes 14 are media tubes which receive a flow of liquid or fluid heating or cooling material such as water. The media tubes 14 include inwardly extending dimples 38 which center the product tubes 12 therein as shown in FIG. 2. These dimples 38 may be disposed at 120° radial increments as shown. The number of required centering and supporting dimples 38 will depend on the number necessary to prevent sagging of the product tubes 12. Any sagging of the product tubes 12 could adversely affect the optimum or proper drainage slope $\beta$. In a tube-in-tube heat exchange apparatus, such as the apparatus 10 shown and described herein, the media flows in a space 13, as shown in FIG. 2, defined within media tube 14 but outside of product tube 12. The media flows countercurrently or, in other words, in a direction opposite to the direction of product flow within product tube 12. Heat transfer takes place between the media in media tubes 14 and the product turbulently flowing through product tubes 12 across walls **12*a* of product tubes 12**.

It will thus be appreciated that the present invention provides a heat exchange tube and apparatus which promotes turbulent flow of fluid to maximize heat transfer but which further allows fast, complete drainage of fluid to aid in clean and place procedures and tube sanitizing or sterilizing procedures.

While the present invention has been described with reference to a specific preferred embodiment, those of ordinary skill in the art will readily recognize many modifications thereof which still fall within the scope of the invention. For example, the turbulating heat exchange tube having a drainage path may be utilized in many other heat transfer systems which would benefit from fast, complete drainage of fluid from the tube. Also, other turbulating structure may be substituted for the dimples shown in the preferred embodiment as long as the drainage path of the present invention remains unobstructed by such structure. Further modifications and substitutions will become apparent upon review of the foregoing specification and applicant therefore intends to be bound only by the scope of the claims appended hereto.

What is claimed is:

1. A heat exchange apparatus comprising a frame and at least one heat exchange tube mounted to said frame so as to define a bottom drainage surface extending along the entire length of said tube, said tube having turbulating structure extending into an inner hollow space thereof for promoting turbulent fluid flow within said tube, said turbulating structure being disposed along said tube and about an inner peripheral surface thereof such that, as viewed from one end, turbulating structure is disposed above and below the central longitudinal axis of said tube as well as on both sides of the central longitudinal axis of said tube but is absent along said bottom drainage surface, said bottom drainage surface being a smooth, even surface extending along said tube and between the turbulating structure disposed on both sides of said smooth, even surface, and said bottom drainage surface further being located directly below the central longitudinal axis of said tube.

2. The apparatus of claim 1 wherein said tube is mounted to said frame at an angle which defines a drainage slope from an upstream end to a downstream end thereof.

3. The apparatus of claim 2 wherein said turbulating structure comprises dimples formed in said tube, said dimples including smoothly curving surfaces in said tube.

4. The apparatus of claim 1 wherein said turbulating structure comprises dimples formed in said tube, said dimples including smoothly curving surfaces in said tube.

5. The apparatus of claim 1 wherein said apparatus is a tube-in-tube apparatus having a series of said tubes, said tubes being inner product tubes and said apparatus further including a series of outer media tubes with each media tube receiving a product tube, and wherein said product tubes are centered within said media tubes by a series of inwardly extending dimples in said media tubes.

6. The apparatus of claim 1 wherein said bottom drainage surface has an arcuate width subtended by an angle between approximately 30° and 90° which is centered on 6 o'clock when said product tube is viewed in cross-section with 12 o'clock being at the top thereof.

* * * * *